US006529110B2

(12) United States Patent
Fedeli et al.

(10) Patent No.: US 6,529,110 B2
(45) Date of Patent: Mar. 4, 2003

(54) MICROCOMPONENT OF THE MICROINDUCTOR OR MICROTRANSFORMER TYPE

(75) Inventors: Jean-Marc Fedeli, Saint Egreve (FR); Bertrand Guillon, Limoges (FR)

(73) Assignee: Memscap, S.A., Saint Ismier (FR)

( * ) Notice: Subject to any disclaimer, the term of this patent is extended or adjusted under 35 U.S.C. 154(b) by 30 days.

(21) Appl. No.: 09/870,819

(22) Filed: May 31, 2001

(65) Prior Publication Data

US 2002/0050906 A1 May 2, 2002

(30) Foreign Application Priority Data

Jun. 29, 2000 (FR) ..... 00 08413

(51) Int. Cl.[7] ..... H01F 5/00
(52) U.S. Cl. ..... 336/174; 336/200; 336/223
(58) Field of Search ..... 336/83, 178, 84 C, 336/212, 200, 174, 147

(56) References Cited

U.S. PATENT DOCUMENTS 5,425,167 A * 6/1995 Shiga et al. ..... 29/606
6,054,329 A * 4/2000 Burghartz et al. ..... 438/3
6,147,582 A * 11/2000 Goldsmith et al. ..... 336/200
6,249,039 B1 * 6/2001 Harvey et al. ..... 257/531

FOREIGN PATENT DOCUMENTS

| | | |
|---|---|---|
| DE | 27 01 296 | 4/1978 |
| EP | 0 642 142 A2 | 3/1995 |
| EP | 0 725 407 A1 | 8/1996 |

OTHER PUBLICATIONS

Ahn, A Fully Integrated Planar Toroidal Inductor with a Micromachined Nicket–Iron Magnetic Bar, pp. 463–469; IEEE Transactions on components, Packaging and Manufacturing Technology, Part A, vol 17, No. 3, dated Sep. 1994.*

K. Shirakawa, et al., "Thin Film Cloth–Structured Inductor for Magnetic Integrated Circuit", Sep. 1, 1990, pp. 2262–2264.

* cited by examiner

*Primary Examiner*—Anh Mai

(57) ABSTRACT

Inductive microcomponent (1), such as a microinductor or microtransformer, comprising a metal winding (2) having the shape of a solenoid and a magnetic core (4) made of a ferromagnetic material positioned at the center of the solenoid (2), wherein the core (4) consists of several sections (13–16) separated by cutouts (17–19) oriented parallel to the main axis (20) of the solenoid (4).

7 Claims, 2 Drawing Sheets

MICROCOMPONENT OF THE MICROINDUCTOR OR MICROTRANSFORMER TYPE

TECHNICAL FIELD

The invention relates to the field of micro-electronics and more specifically, to the sector for fabricating microcomponents, especially those intended to be used in radio frequency applications. More specifically, it relates to microcomponents such as microinductors or microtransformers equipped with a magnetic core allowing the operation at particularly high frequencies.

PRIOR ART

As is known, electronic circuits used for radio frequency applications, especially such as mobile telephony, comprise oscillating circuits including capacitors and inductors.

Given the trend toward miniaturization, it is essential that microcomponents such as microinductors occupy an increasingly small volume, while keeping a value of inductance which is high enough and a high quality coefficient.

Moreover, the general trend is toward increasing operating frequencies. Thus, mention may be made by way of example of the frequencies used in the new UMTS standards of mobile telephony, which are in the region of 2.4 gigahertz, in comparison with the frequencies of 900 and 1800 megahertz used for the GSM standard.

The increase in operating frequencies poses problems relating to the behavior of magnetic cores of microinductors.

This is because, in order to obtain a good quality factor, an increase in the inductance of the microinductor is generally sought. To this end, magnetic materials are chosen, the geometry and dimensions of which enable the greatest possible permeability to be obtained.

However, given the phenomena of gyromagnetism, it is known that the permeability varies according to the frequency, and more specifically, that there is a resonance frequency beyond which an inductor has capacitative behavior. In other words, a microinductor absolutely must be used at frequencies below this resonance frequency.

However, increasing the frequencies of use therefore comes up against the phenomenon of gyromagnetic resonance, which, for a given geometry, limits the frequency range in which the inductor can be used in an optimal manner.

A problem which the invention proposes to solve is that of the limitation of the frequency of use inherent to the existence of a phenomenon of gyromagnetism.

SUMMARY OF THE INVENTION

The aim of the invention is therefore an inductive microcomponent, such as a microinductor or microtransformer, comprising a metal winding having the shape of a solenoid and a magnetic core made of ferromagnetic material positioned at the center of the winding.

According to the invention, the core of this microcomponent consists of several sections separated by cutouts oriented perpendicularly to the main axis of the solenoid.

In other words, the magnetic core does not form a monolithic part aligned along the axis of the solenoid, but on the contrary it is segmented in the direction of the solenoid.

The fractionation of the magnetic core causes a decrease in the magnetic permeability of each section, and therefore a decrease in the value of inductance of the microcomponent. Nevertheless, it has been noticed that this drawback is compensated for by the increase in the maximum frequency to which the microcomponent keeps its inductive behavior.

The gyromagnetic resonance frequency is determined by the Landau-Lifschitz equation which follows:

$$\frac{1}{\gamma}\frac{\partial \vec{M}}{\partial t} = \vec{M} \wedge \vec{H} + \frac{\alpha}{\gamma Ms}\frac{\partial \vec{M}}{\partial t} \wedge \vec{M}$$

in which:

M is the magnetic moment,

H is the magnetic field in which this moment is immersed, $\gamma$ is the gyromagnetic constant, $\alpha$ a is the damping factor.

In order to determine the permeability along the difficult axis of the ferromagnetic material, which corresponds to the main axis of the solenoid, we need to determine the various magnetic fields to which the material is subject. Thus, when a material of a given shape is immersed in a magnetic field ($H_{ext}$), the magnetizations have a tendency to align themselves.

The neutrality of the material is therefore lost, charges appear which create a field opposing the external field, thus decreasing the resultant internal field ($H_{int}$). The field opposing the external field is generally called a "demagnetizing field" ($H_d$), and depends strongly on the geometry. More specifically, the demagnetizing field coefficient is called N such that:

$$\vec{H}_d = -N\vec{M}$$

This coefficient depends only on the geometry. This demagnetizing field, created by magnetic components in the direction of the difficult axis decreases the resulting internal field and therefore opposes the passage of the flux lines. In other words, this demagnetizing field has the consequence of reducing the permeability.

Thus, by taking into account this model, it is possible to solve the Landau-Lifschitz equation in order to determine the value of the permeability along the difficult axis. As is known, the magnetic permeability is a complex quantity in which the real part represents the effective permeability, while the imaginary part represents the losses. Thus, solving these equations gives the values of the real part ($\mu'$) and of the imaginary ($\mu''$) as a function of the frequency, of N and of the intrinsic properties of the material.

The resonance frequency, for which the value of $\mu''$ is maximum, is as follows:

$$f_{res} = \frac{\gamma}{2\pi}\sqrt{(H_k + N \cdot 4\pi M_s)(H_k + 4 \cdot \pi M_s)}$$

in which:

N is the demagnetizing field coefficient, $\gamma$ is the gyromagnetic constant, $H_k$ is the value of the saturation magnetic field, and $M_s$ is the value of the magnetic moment at saturation.

It is therefore found that the resonance frequency increases with the demagnetizing field coefficient N. For parallelepipedal geometries, the demagnetizing field coefficient depends on:

the length of the parallelepiped measured along the difficult axis, that is to say, along the solenoid axis, the thickness of the parallelepiped, the width along the easy access.

Thus, by virtue of the geometry chosen for the core according to the invention, the magnetizing field coefficient is considerably higher than for a monolithic core occupying the whole length of the solenoid. It follows that the demagnetizing field is also stronger and that the magnetic permeability along the difficult axis is smaller.

In return, the resonance frequency for the gyromagnetic effect is higher, which makes it possible to use the microinductor or the microtransformer at higher frequencies.

Advantageously, in practice, it has been determined that the coupling phenomena between the various sections of the core are negligible or have little effect when the width of the cutouts separating the sections of the core, measured in the direction of the solenoid axis, is greater than four times the thickness of the core.

When this width is considerably less than this value, the magnetic coupling phenomena between the various sections contribute to giving the set of sections a behavior which is similar to that of a monolithic core, with the already stated limitation relating to the resonance frequency. Conversely, when the separation of the sections is too great, the value of the inductance reduces because of the reduction in the magnetic volume.

Advantageously, in practice the thickness of the core may be between 0.1 and 10 micrometers. Indeed, it has been found that it is possible to overcome induced current phenomena, which are correspondingly greater the higher the frequency of use, by limiting as much as possible the thickness of each section of the magnetic core.

However, in order to keep a high enough value of permeability, it is possible, in a particular embodiment of the invention, to make the core from several superimposed magnetic layers, each one having a limited thickness.

In practice, the core can be made from materials chosen from the group comprising iron, nickel, cobalt, zirconium or niobium based alloys.

Microinductors having a minimum series resistance and therefore a particularly high quality factor are obtained by making the solenoid from electrolytic copper, which can be deposited on an insulating substrate such as quartz or glass. The solenoid can also be deposited on a conducting or semi-conducting substrate, with the interposition of an insulating layer between this substrate and the solenoid.

BRIEF DESCRIPTION OF THE DRAWINGS

The manner of embodying the invention and the advantages which result therefrom will emerge properly from the description of the embodiment which follows, with reference to the appended figures in which.

MANNER OF EMBODYING THE INVENTION

As already stated, the invention relates to microcomponents such as a microinductor or micro-transformer, the magnetic core of which is divided into fractions.

Figure 1:
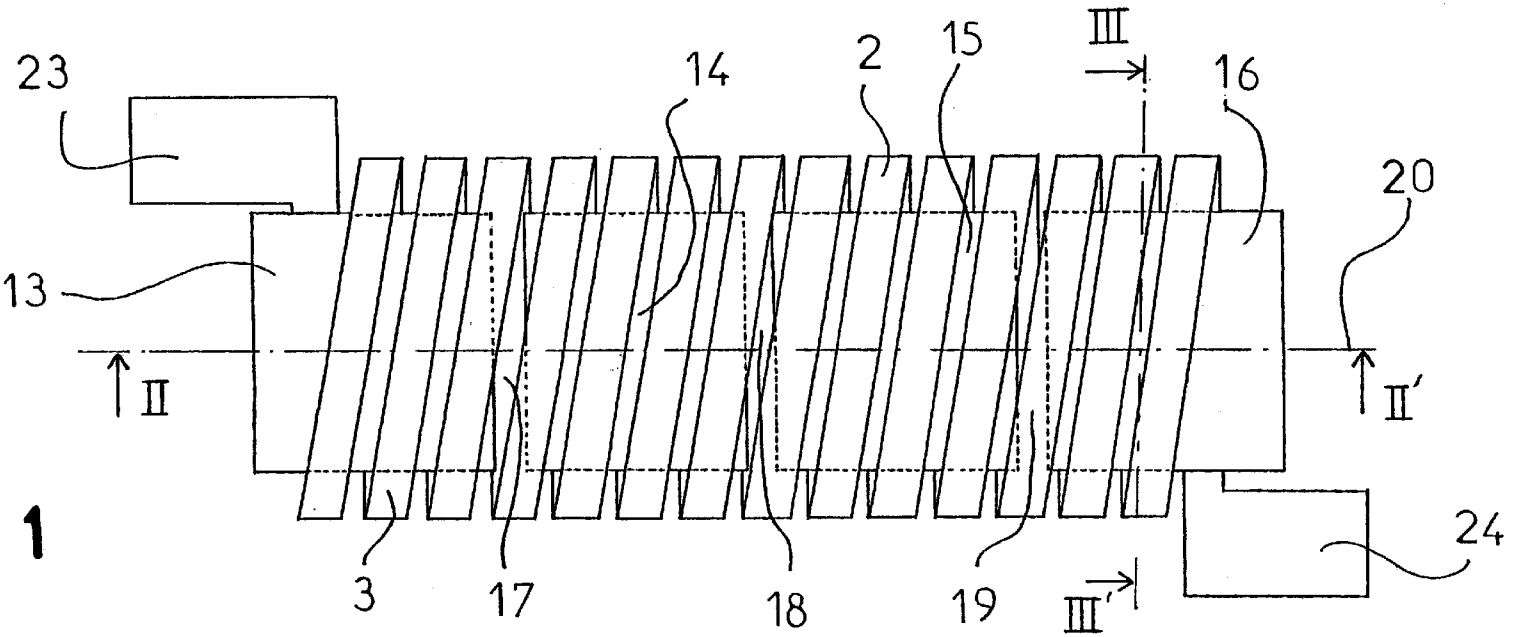
FIG. 1 is a schematic top view of a micro-inductor made according to the invention.

As illustrated in FIG. 1, a microinductor (1) according to the invention comprises a metal winding (2) consisting of a plurality of turns (3) wound around the magnetic core.

More specifically, each turn (3) of the solenoid comprises a lower part (5) which is inserted on the surface of the substrate (6) and a plurality of arches (7) connecting the ends (8, 9) of the adjacent lower parts (5, 5').

Thus, in order to obtain such an inductor, a plurality of parallel channels (10) are etched on the upper face of an insulating substrate or of an insulating layer on a conducting or semiconducting substrate (6). The lower parts (5) of each turn (3) are obtained by electrolytic growth of copper, then the surface of the substrate (6) is planarized in order to produce an optimal surface condition.

Next, a layer of silica (11) is deposited on top of the upper face of the substrate (6) so as to insulate the lower parts (5) of the turns from the magnetic materials which will be deposited on top.

Next, the magnetic core (4) is made, which can be produced by various techniques, such as spruttering of electrolytic deposition. Thus, using an additive technique, the electrolytic deposition of the magnetic material takes place on top of predetermined growth regions, located on top of the plurality of segments (5) forming the lower parts of the turns.

According to the invention, the magnetic core (4) has several sections (13–16) separated from each other by cutouts (17–19) perpendicular to the longitudinal axis (20) of the solenoid (2). The number of sections of the magnetic core (4) is determined according to various parameters such as the type of magnetic material used, the maximum frequency to which the inductor has to be used, the desired value of inductance and the thickness of the layer of magnetic material.

In the example illustrated, the magnetic core (4) comprises four sections (13–16) separated by three cutouts (17–19). These four sections (13–16) can be obtained, as already said, by an additive technique in which the electrolytic deposition takes place over four growth regions drawn above copper segments (5).

These four sections (13–16) can also be obtained by a subtractive technique consisting, in a first step, in depositing a uniform magnetic layer over the substrate, then, in a second step in removing the magnetic material in order to form the various sections.

Figure 2:
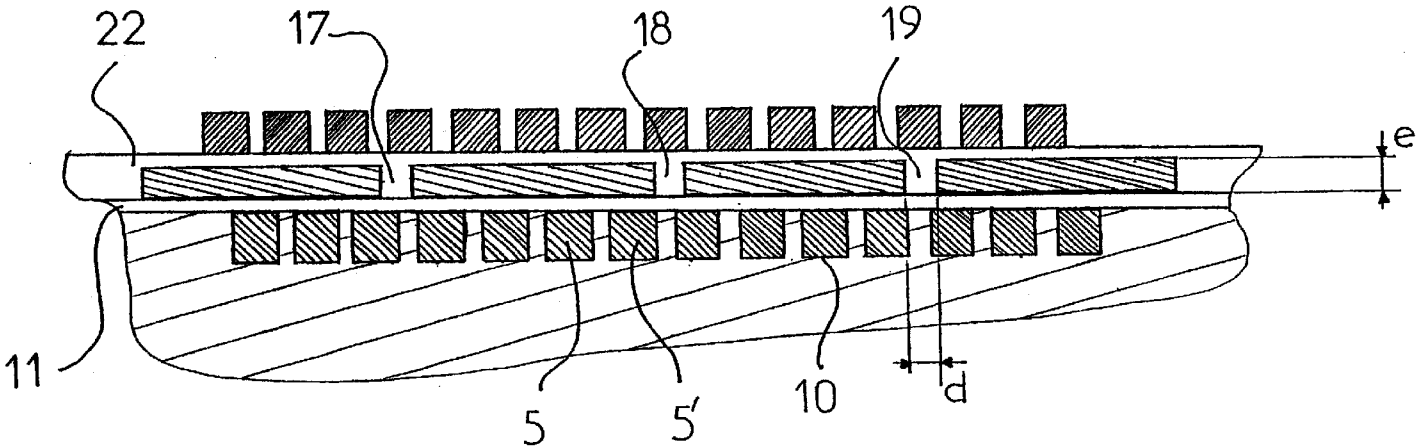
FIG. 2 is a longitudinal sectional view along a plane II–II' of FIG. 1.
Figure 3:
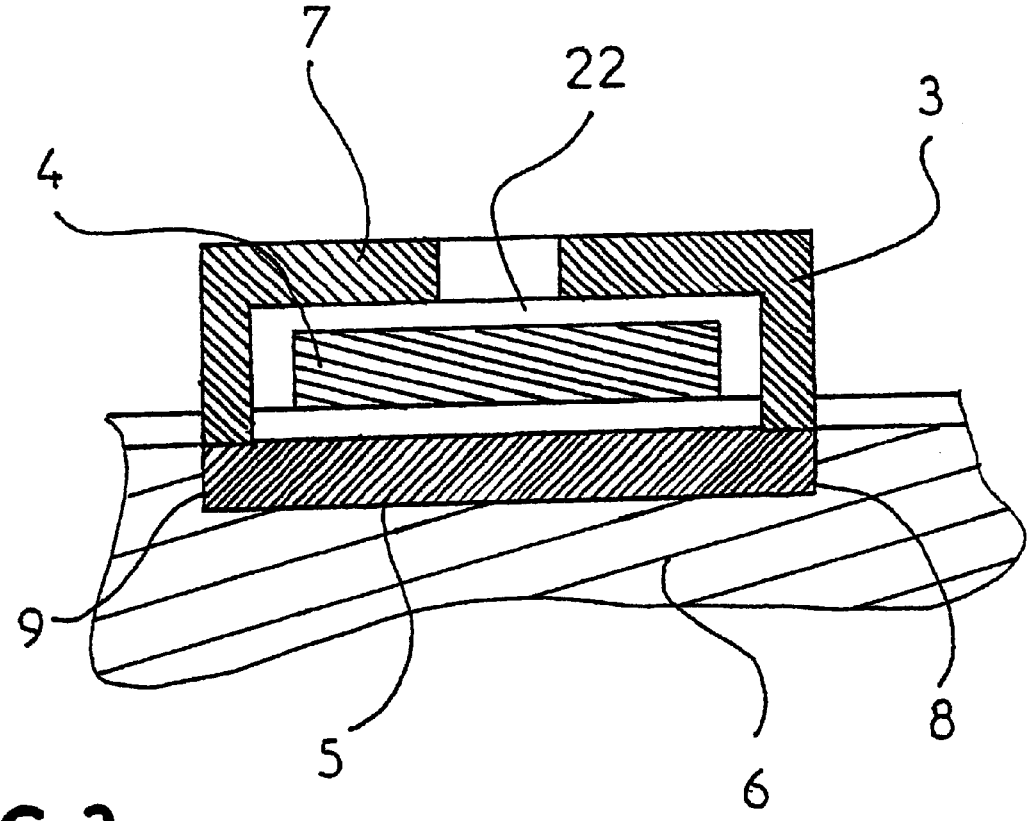
FIG. 3 is a transverse sectional view along the plane III–III' of FIG. 1.

The thickness (e) of the magnetic layer (13–16) is chosen between 0.1 and 10 micrometers in order to obtain a high enough inductance while limiting thereby the phenomena of induced currents. The width (d) of the cutouts (17–19) separating each section (13–16) is preferably chosen to be close to four times the thickness (e) of the layer of magnetic material. This ratio is not complied with in FIG. 2 solely for reasons of clarity in the figure. It is possible to increase the overall thickness of the magnetic core (4) by depositing several superimposed layers of magnetic material, insulated from each other by preferably insulating nonmagnetic layers such as silica or silicon nitride.

After having made the core from a magnetic material (4), a layer of silica (22), intended to electrically insulate the magnetic core (4) from the upper part (7) of the turns (2), is deposited.

Subsequently, electrolytic deposition of copper is carried out in order to form arches (7) connecting the opposite end of the adjacent lower parts (5, 5"), in order to produce the microcomponent illustrated in FIG. 1. Subsequent steps for creating connection pads (23, 24) and a possible passivation can be carried out.

As already said, the magnetic materials used can be relatively varied, provided they have high magnetization and controlled anisotropy. Thus, crystalline or amorphous materials such as, for example, CoZrNb could be used.

Moreover, the solenoid can be made of copper as illustrated, or else other materials with low resistivity, such as gold, can be incorporated.

Although the invention is described in more detail with regard to a microinductor, it goes without saying that the production of a microtransformer, including two windings wound around a common core, is also covered by the invention.

It emerges from the above that the microcomponents according to the invention have multiple advantages and, in particular, they increase the maximum operating frequency with regard to microcomponents of identical size and material.

These microcomponents find a very specific application in radio frequency applications and, especially, in mobile telephony.

What is claimed is:

1. An inductive microcomponent (1), comprising a metal winding (2) having the shape of a solenoid and a magnetic core (4) made of ferromagnetic material positioned at the center of the solenoid (2), wherein the core (4) consists of several sections (13–16) separated by cutouts (17–19) oriented perpendicularly to a main axis (20) of the solenoid (4).

2. The microcomponent as claimed in claim 1, wherein the width (d) of the cutouts (17–19) separating each section (13–16) of the core (4), measured in the direction of the main axis (20) of the solenoid, is greater than four times the thickness (e) of the core (4).

3. The microcomponent as claimed in claim 2, wherein the thickness (e) of the core is between 0.1 and 10 micrometers.

4. The microcomponent as claimed in claim 1, wherein the solenoid (2) is made from electrolytic copper deposited on an insulating layer present on a conducting or semiconducting substrate (6).

5. The microcomponent as claimed in claim 1, wherein the solenoid (2) is made from electrolytic copper deposited on an insulating substrate.

6. The microcomponent as claimed in claim 1, wherein the core (4) is made from a material chosen from the group comprising iron, nickel, cobalt, zirconium or niobium based alloys.

7. The microcomponent as claimed in claim 1, wherein the core is made of several superimposed layers.

* * * * *